US005245352A

United States Patent [19]

Nalos et al.

[11] Patent Number: 5,245,352

[45] Date of Patent: Sep. 14, 1993

[54] THRESHOLD SENSITIVE LOW VISIBILITY REFLECTING SURFACE

[75] Inventors: Ervin J. Nalos, Bellevue; James C. Axtell, Des Moines, both of Wash.

[73] Assignee: The Boeing Company, Seattle, Wash.

[21] Appl. No.: 430,486

[22] Filed: Sep. 30, 1982

[51] Int. Cl.[5] ..... H01Q 13/10

[52] U.S. Cl. ..... 343/768

[58] Field of Search ..... 343/768, 909, 754, 755, 343/756, 18 B, 18 D, 352, 353, 775, 768, 777, 756, 909, 18 R, 18 C

[56] References Cited

U.S. PATENT DOCUMENTS

| | | | |
|---|---|---|---|
| 2,880,310 | 3/1959 | Jakes, Jr. | 343/18 B |
| 3,148,370 | 9/1964 | Bowman . | |
| 3,231,892 | 1/1966 | Matson et al. | 343/775 |
| 3,257,659 | 6/1966 | Siegel | 343/18 D |
| 3,305,863 | 2/1967 | Jacobs . | |
| 3,308,464 | 3/1967 | Lewis . | |
| 3,392,393 | 7/1968 | Spitz | 343/754 |
| 3,535,543 | 10/1970 | Dailey | 343/352 |
| 3,568,194 | 10/1970 | Wilson et al. . | |
| 3,623,091 | 11/1971 | Mayo, Jr. et al. | 343/18 D |
| 3,703,723 | 11/1972 | Albanese et al. . | |
| 3,769,623 | 10/1973 | Fletcher et al. . | |
| 3,789,404 | 1/1974 | Munk . | |
| 3,842,421 | 10/1974 | Rootsey et al. . | |
| 3,896,440 | 7/1975 | Wheeler | 343/18 D |
| 3,975,738 | 8/1976 | Pelton et al. | 343/909 |
| 4,021,813 | 5/1977 | Black et al. | 343/768 |
| 4,125,841 | 11/1978 | Munk . | |
| 4,126,866 | 11/1978 | Pelton . | |
| 4,148,032 | 4/1979 | Kelly et al. . | |
| 4,160,254 | 7/1979 | Wise . | |
| 4,314,249 | 2/1982 | Onoe | 343/18 D |
| 4,320,404 | 3/1982 | Chekroun | 343/754 |

FOREIGN PATENT DOCUMENTS

| | | | |
|---|---|---|---|
| 0074295 | 3/1983 | European Pat. Off. | 343/18 B |
| 814310 | 2/1955 | United Kingdom | 343/18 A |

OTHER PUBLICATIONS

Onoe et al., Radar Reflectors with Controllable Reflection, 3/80 Electronics & Communications in Japan, vol. 63 B pp. 51-58.

The Random House Dictionary of the English Language 1980 p. 1022.

*Primary Examiner*—Theodore M. Blum

*Attorney, Agent, or Firm*—J. Peter Mohn

[57] ABSTRACT

A non-linear solid state conductor placed across a resonant aperture formed in a surface reflective of electromagnetic energy becomes conductive under the influence of a microwave field above a threshhold energy level of intensity to render the resonant aperture fully reflecting for the bandwidth of frequencies associated with the geometry of the resonant aperture.

14 Claims, 4 Drawing Sheets

THRESHOLD SENSITIVE LOW VISIBILITY REFLECTING SURFACE

FIELD OF THE INVENTION

This invention relates to surfaces reflective of electromagnetic energy, and particularly to reflective surfaces which switch from non-reflecting to reflecting for a resonant band of frequencies in response to a threshold intensity level of incident microwave energy.

BACKGROUND OF THE INVENTION

A reflecting surface may be provided with periodic resonant apertures or slots. Such a reflecting surface will reflect incident electromagnetic energy in all frequency bands except for the band of frequencies associated with the geometry, *i.e.*, the size and shape, of the resonant slots and the periodic spacing of the slots on the reflecting surface. In principle, these resonant slots act as perfect band-pass filter circuits. The centerband frequency of radiation transmitted through these slots is a function of the periodic spacing of the resonant slots. The size and shape of the slots determines the width and shape of the band of frequencies transmitted through the slots. The resonant apertures, or resonant slots, can be made effective for all polarizations of incident electromagnetic energy (and therefore said to be polarization insensitive) in one of several geometric configurations. They may be of the "cross"-type, which covers both horizontal and vertical polarizations of incident electromagnetic energy, or of the "Y"-type, which also covers both horizontal and vertical polarizations. The radiation incident upon the resonant aperture in the band of frequencies associated with the resonant slot geometry is partially transmitted, partially back-scattered and partially reflected. The visibility of the reflecting surface is greatly reduced in the pertinent band of frequencies, because very little energy is reflected.

However, it is often desirable to reduce the visibility of a large flat or curved reflecting surface to signals emitted by a distant transmitter, while at the same time providing a good reflecting surface for signals emitted from a nearby transmitter in the same frequency band as the distant transmitter.

It is possible to render the resonant slot fully reflecting in the relevant band of frequencies by connecting a switching diode across the center of the resonant slot and rendering the diode conductive by the application of a direct current bias voltage across the diode from an external power source, as disclosed in U.S. Pat. No. 4,314,249 to *Onoe*, which is incorporated herein by reference.

It is also desirable to render the resonant slots fully reflecting without employing conductance means dependent upon external power sources, *i.e.*, power sources other than the power source provided by the electromagnetic energy incident upon the reflecting surface. Power sources external to the power provided by the electromagnetic energy incident upon the reflecting surface require additional transmission apparatus and introduce additional requirements for initiating diode switching.

OBJECTS AND SUMMARY OF THE INVENTION

It is, therefore, an object of the present invention to provide a means for rendering conductive a set of resonant slots in a reflecting surface by the incidence of high energy microwave electromagnetic radiation upon the slots.

It is also an object of the present invention to effect modification of the reflecting characteristics of a reflecting surface by employing the power present in the electromagnetic radiation incident upon the reflecting surface, rather than by variation of the internal biases of the reflecting surface by means of an external power source.

A further object of the present invention is to provide a threshold energy sensitive low visibility reflecting surface in which the threshold energy for switching from non-reflecting to fully reflecting in the resonant frequency band is supplied by electromagnetic energy incident upon the reflecting surface.

Another object of the present invention is to provide a threshold energy sensitive, low visibility reflecting surface in which the threshold energy for switching the surface from non-reflecting to fully reflecting in the resonant frequency band is supplied by a microwave feed wave incident upon the reflecting surface.

A further object of the present invention is to provide a variable aperture reflecting surface by illuminating only that region of the surface desired to be reflective. The desired illumination will be effected by remote beam focusing of a microwave feed wave.

It is also an object of the present invention to provide a reflecting surface having low visibility to distant transmitters and high visibility, *i.e.*, fully reflecting, to nearby transmitters.

These and other objects of the invention are accomplished by a threshold energy microwave switchable resonant electromagnetic energy reflecting surface, which comprises a surface reflective of electromagnetic energy; a plurality of polarization insensitive elements mounted on the surface in an array; and threshold radiation sensitive means connected to the elements for rendering the elements conducting only when the radiation sensitive means receives microwave radiation at or above the threshold intensity level of the radiation sensitive means.

A non-linear solid state semiconductor, such as a diode, may serve as the threshold radiation sensitive means, and slots of cross-shaped or Y-shaped geometry may serve as typical polarization insensitive elements.

BRIEF DESCRIPTION OF THE DRAWINGS

The accompanying drawings, which are incorporated in and constitute a part of the specification, illustrate an embodiment of the invention and, together with the description, serve to explain the principles of the invention.

DETAILED DESCRIPTION OF THE PREFERRED EMBODIMENT

Figure 1:
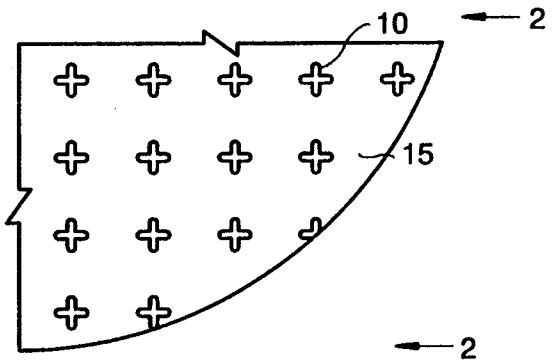
FIG. 1 is a front plan view of a partial section of a reflective surface having one set of apertures or slots mounted thereon according to the present invention.

FIG. 1 illustrates a partial section of a reflecting surface according to the present invention. An array of apertures 10 is formed as a portion of reflective surface 15. Other slot configurations, or sets of slot configurations, can also be considered. Several sets of slots may be provided on the same reflector, one set for each band of frequencies of interest.

Figure 2:
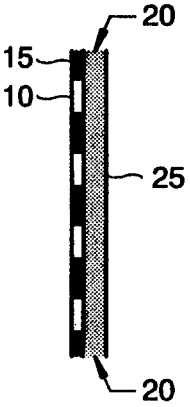
FIG. 2 is a cross-sectional view of one embodiment of the array of FIG. 1 taken along line 2—2.
Figure 3:
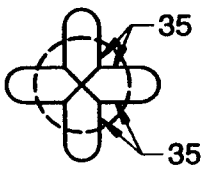
FIG. 3 is an enlarged plan view of an individual slot of the array in FIG. 1.
Figure 4:
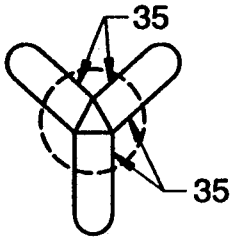
FIG. 4 is an enlarged view of an alternative geometrical embodiment for an individual slot of FIG. 1.

The apertures may be cross-shaped, as shown in FIG. 3, or Y-shaped, as shown in FIG. 4. The reflective surface 15 may be mounted upon a lossy dielectric backing 20, as shown in FIG. 2. A second reflective surface 25 may be provided as backing for the lossy dielectric backing 20. Reflective surface 15 may be planar, parabolic or otherwise curved. The lossy dielectric backing 20 and the second reflective surface 25 conform to the planar, parabolic or other curvature of reflective surface 15. Suitable materials for the reflective surfaces, 15 or 25, are aluminum, copper and generally any metallic surface, including metallic films vapor deposited on a dielectric backing or metallic fine meshes. Suitable materials for the lossy dielectric backing 20 are carbon loaded ceramic and styrefoam impregnated with carbon or graphite.

The lossy dielectric backing 20 functions to absorb electromagnetic energy transmitted through apertures 10. The absorptive capability of the lossy dielectric backing 20 is dependent upon the distance travelled by the electromagnetic energy through the lossy dielectric backing. The greater the distance travelled, the greater the degree of absorption. Any given intensity of electromagnetic energy will be completely absorbed after travelling a certain distance through a lossy dielectric material. Reflective surface 25 ensures that electromagnetic energy transmitted through the resonant apertures 10 will undergo multiple reflections until totally absorbed within lossy dielectric 20. The lossy dielectric backing 20 and the second reflective surface 25 are optional. They are primarily useful for preventing microwave energy transmitted through apertures 10 from damaging or otherwise affecting microwave sensitive equipment, which may be situated behind reflective surface 15. However, scattering in both the forward and backward direction from the reflective surface 15 is permitted, and in such cases the lossy dielectric backing 20 and the second reflective surface 25 would be omitted.

Figure 5:
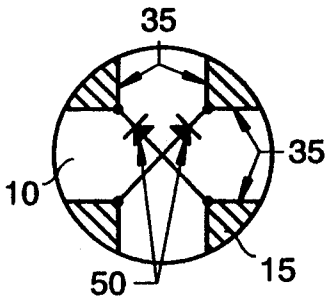
FIG. 5 is an enlarged view of the dotted line section of FIG. 3.

Provision is made for rendering the apertures 10 conductive of electromagnetic energy. This may be accomplished by providing electrical connection on the edge surfaces 35 of each aperture. As shown in FIG. 5, which is an enlarged view of the central section of the aperture shown in FIG. 3, a threshold energy sensitive electrically conducting path is provided across each aperture by attaching on diametrically opposing edge surfaces of the aperture a threshold energy sensitive electrically conducting element. In FIG. 5, the electrically conducting elements provided for purposes of rendering the aperture conducting are two diodes 50. Additional diodes 50 can be placed between opposing edges of the resonant slots to ensure a fully reflecting surface over a different bandwidth of the resonant frequency.

The non-conductive nature of the diode will prevent the diode from being shorted at the point of diode contact with the aperture unless the incident radiation energy level rises above a certain threshold energy level. Thus, the diode operates as a threshold radiation sensitive means. This threshold energy level is determined in accordance with the detailed internal rectification properties of the diode in question, the proximity of the high frequency radiation source, the frequency of the high frequency source and the location of the diode, or diodes, on the resonant slot geometry in question.

Figure 6:
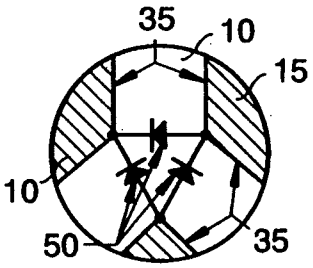
FIG. 6 is an enlarged view of the dotted line section of FIG. 4.

FIG. 6 illustrates an alternative arrangement of diodes used in rendering conductive an aperture having a Y-shaped geometry. The three vertices of the Y-shaped aperture are interconnected by means of three diodes 50.

In accordance with the present invention, diodes 50, or related non-linear solid state semiconductors with a specific doping profile, such as exhibited in PIN diodes, become conductive upon exposure to a threshold energy level microwave radiation field to short, and therefore render fully reflecting, the resonant slots 10 arranged in an array on reflective surface 15. Below the threshold energy level, the resonant aperture 10 is merely modified by the base capacitance of the diode 50. This modification of the base capacitance of the diode results in a calculable design change in the slot geometry. The modification of the slot geometry in turn results in a variation of the design bandwidth and band shape of the associated resonant frequency band. When the diode is illuminated by a microwave energy source of threshold level intensity, the diode will be rendered conductive and the corresponding resonant aperture 10 will be shorted. Shorting the resonant apertures renders the reflective surface 15 fully reflecting in the frequency band associated with the geometry of the apertures 10 and their spacing on the reflective surface 15. In other words, when the threshold intensity of microwave energy renders the diode conductive and shorts the aperture, the aperture can be regarded as "decoupled" from the surface because shorting the aperture prevents it from rendering the surface transmissive, rather than reflective, of the particular radiation frequency band associated with the aperture geometry. The threshold level for conduction is typically a few milliwatts/cm$^2$.

Figure 7:
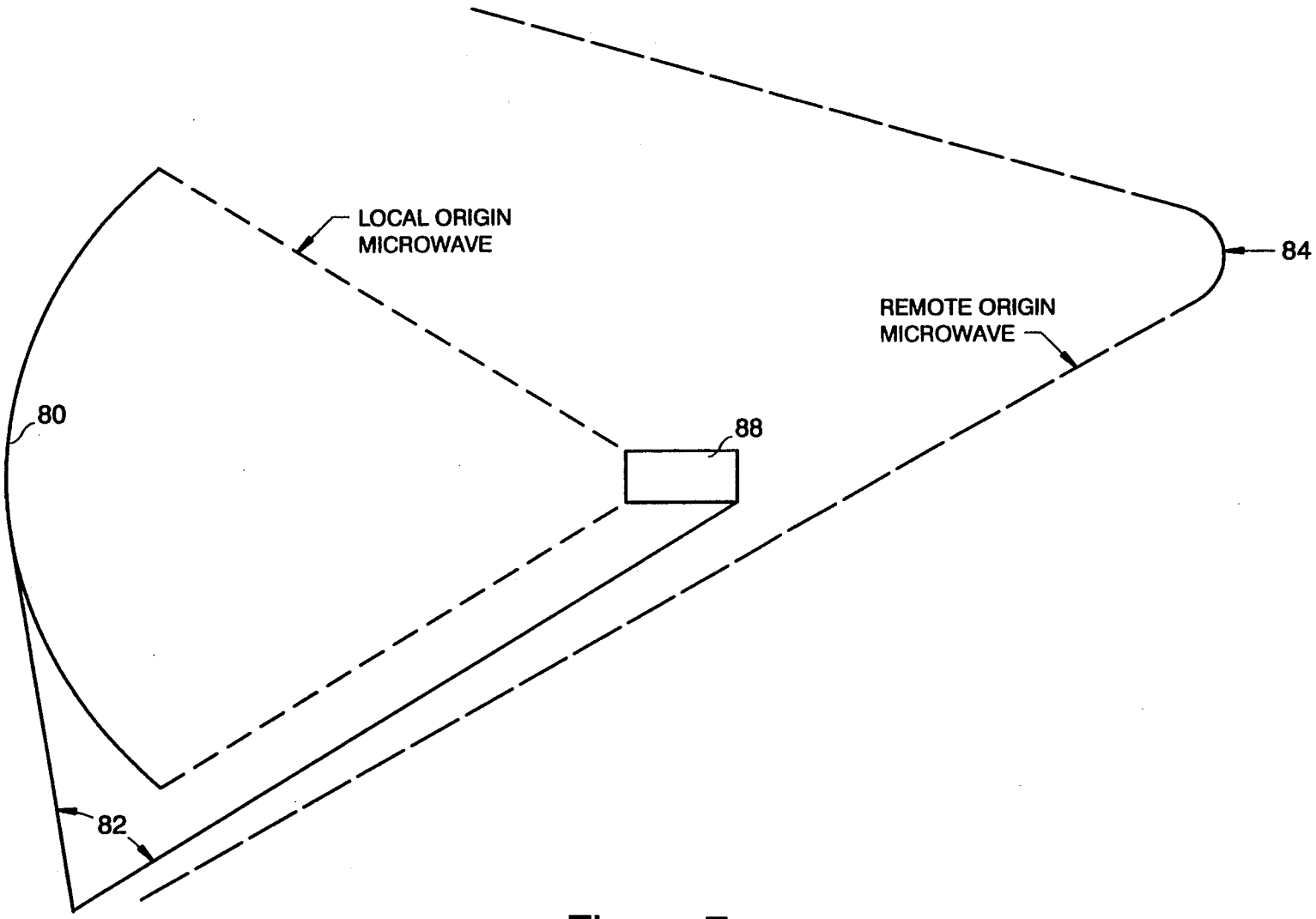
FIG. 7 is a schematic of two alternative embodiments of the present invention.

The illuminating energy, *i.e.*, the energy level required to render the apertures fully reflecting, may be supplied either by a nearby microwave feed or the incident energy emitted by a distant transmitter, as shown in FIG. 7. It is possible to render the reflective surface fully reflecting by means of a local microwave feed when the energy level of the remote source incident electromagnetic signal, alone, would be insufficient to attain the threshold energy for shorting the resonant slots. Thus, by employing a local microwave feed the reflective surface can provide full gain as a transmitting aperture for purposes of efficiently illuminating a distant object.

It is also possible to provide a variable aperture reflecting surface by providing a focused microwave feed beam for illuminating only that region of the curved reflecting surface desired to be rendered reflecting. The illumination is accomplished by conventional focusing of a remote feed beam of electromagnetic microwave energy. This can be accomplished, for example, by displacing the feed beam source, as shown in both FIGS. 7 and 8, from the focal center of the curved reflective surface. The remote feed microwave beam illuminates only a portion of the curved surface, and only the illuminated portion is rendered reflecting (hence "visible") in the relevant band of resonant frequencies.

Figure 8:
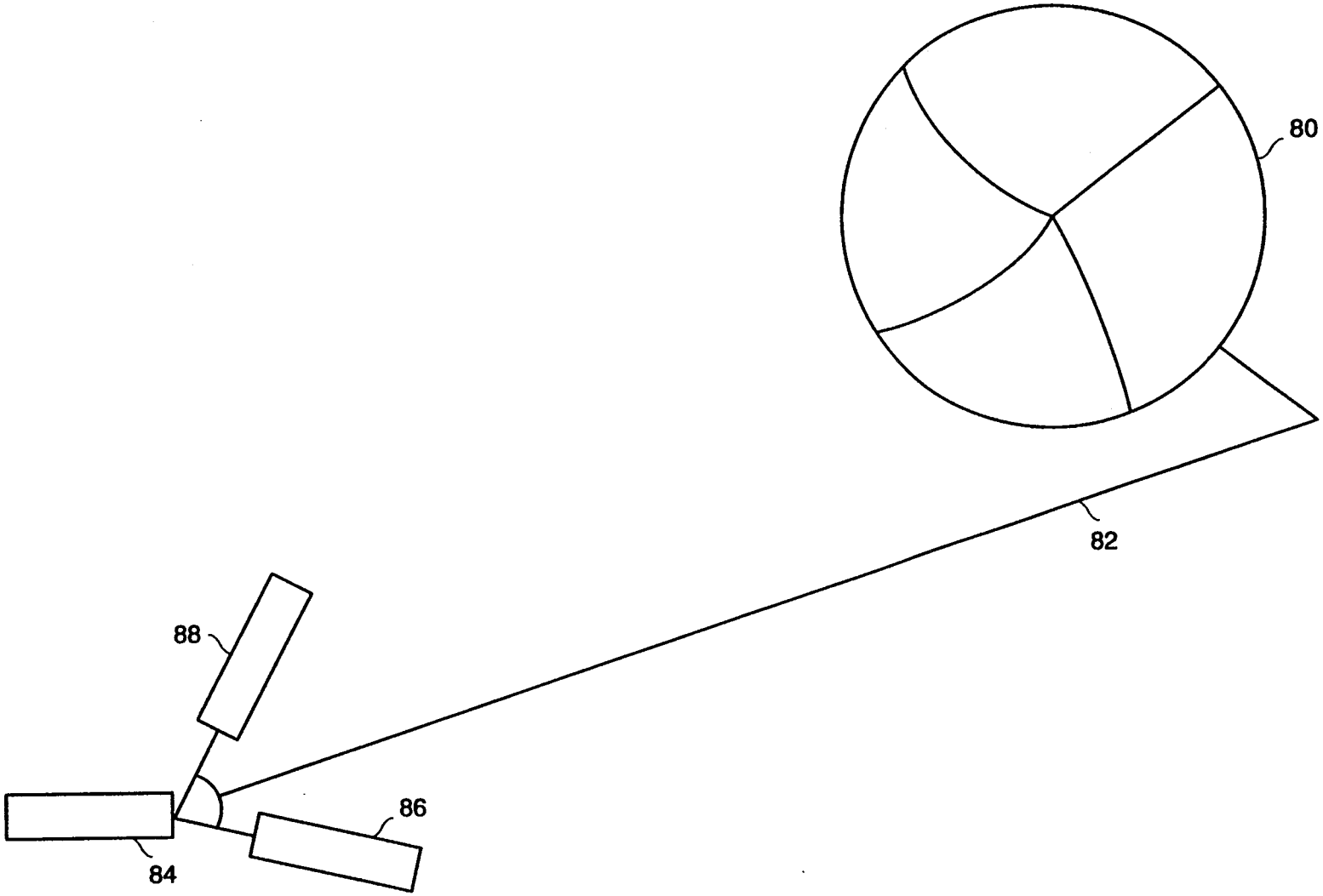
FIG. 8 is a schematic of a further alternative embodiment of the present invention.

As shown schematically in FIG. 8, applicants envision one use of their invention in a large orbiting space-based structure. Reflector dish 80 would contain resonant slots modified in accordance with the present invention. Support structure 82 connects dish 80 to power source 84, solar collector 86 and microwave feed 88.

It further will be apparent to those skilled in the art that various modifications and variations can be made to the reflection/non-reflection switching means of the instant invention without departing from the scope or spirit of the invention, and it is intended that the present invention cover these modifications and variations provided that they come within the scope of the appended claims and their equivalents.

What is claimed is:

1. A threshold energy, microwave switchable, electromagnetic energy reflecting surface comprising:

a surface member having first surface portions reflective of electromagnetic energy and second surface portions including a sufficient number of polarization insensitive elements to render said surface member invisible for at least one predetermined frequency band of incident electromagnetic energy; and threshold radiation sensitive means having a predetermined threshold intensity level and connected to each said element and rendering said element electrically conducting only when microwave radiation of at least said predetermined threshold intensity level is incident upon said threshold radiation sensitive means.

2. A threshold energy, microwave switchable, electromagnetic energy reflecting surface, comprising:

a surface member having a first surface portion reflective of electromagnetic energy;

a plurality of polarization insensitive elements forming an array of second surface portions on said surface member for rendering said surface member invisible for at least one predetermined frequency band of incident electromagnetic energy; and threshold radiation sensitive means connected to said elements for rendering said elements electrically conducting only when microwave radiation at or above the threshold intensity level of said means is incident upon said means whereby said surface member is rendered reflective of incident electromagnetic energy at said predetermined frequency band.

3. An energy reflecting surface as recited in claim 2, wherein said polarization insensitive elements are formed by a set of apertures in said surface member.

4. An energy reflecting surface as recited in claim 3, wherein each said aperture is formed by three elongated openings emanating from a common point.

5. An energy reflecting surface as recited in claim 3, wherein each said aperture is formed by two intersecting elongated openings.

6. An energy reflecting surface as recited in claim 2, wherein said threshold radiation sensitive means comprises at least one non-linear solid state semiconductor.

7. An energy reflecting surface as recited in claim 2, wherein said threshold radiation sensitive means comprises at least one diode.

8. An energy reflecting surface as recited in claim 2, wherein each said threshold radiation sensitive means comprises at least one PIN diode.

9. An energy reflecting surface as recited in claim 2, wherein said surface member comprises a first outside layer reflective of electromagnetic energy and receiving said polarization insensitive elements, a second outside layer reflective of electromagnetic energy; and an intermediate layer of a lossy dielectric positioned intermediate said first outside layer and said second outside layer.

10. An energy reflecting surface as recited in claim 2, wherein said surface member is planar in shape.

11. An energy reflecting surface as recited in claim 2, wherein said surface member is curved in shape.

12. An energy reflecting surface as recited in claim 2, wherein said surface member is parabolic in shape.

13. An energy reflecting surface as recited in claim 11 or 12, also including means for focusing incident electromagnetic energy upon predetermined portions of said surface.

14. A remotely switchable, electromagnetic energy, reflector, comprising:

a surface reflective of electromagnetic energy;

an array of radiating elements provided in said surface with selective transmission and reflection properties; and means for electrically decoupling said array of radiating elements from said surface for making said surface entirely reflecting, wherein said decoupling means is operative only at or above a preselected threshold level of electromagnetic energy incident upon said surface.

* * * * *